United States Patent [19]

Shaffer

[11] Patent Number: 4,889,018

[45] Date of Patent: Dec. 26, 1989

[54] LID REMOVER

[76] Inventor: Roy E. Shaffer, 2500 Glenmary St. - Apt. 3, Louisville, Ky. 40204

[21] Appl. No.: 265,506

[22] Filed: Nov. 1, 1988

[51] Int. Cl.[4] ..... B67B 7/00

[52] U.S. Cl. ..... 81/3.43; 81/64

[58] Field of Search ..... 81/3.43, 3.4, 64, 65

[56] References Cited

U.S. PATENT DOCUMENTS

| | | | |
|---|---|---|---|
| D. 268,164 | 3/1983 | Sandberg | 81/3.43 |
| 178,655 | 6/1876 | McLain . | |
| 285,048 | 9/1883 | Liljencrantz . | |
| 1,348,532 | 8/1920 | Arndt . | |
| 2,458,393 | 1/1949 | Loudfoot . | |
| 2,771,802 | 11/1956 | Lewis . | |
| 3,678,788 | 7/1972 | Matti | 81/3.43 |
| 4,552,040 | 11/1985 | Bang | 81/3.43 |

FOREIGN PATENT DOCUMENTS

| | | | |
|---|---|---|---|
| 647271 | 7/1928 | France | 81/64 |

*Primary Examiner*—Roscoe V. Parker

*Attorney, Agent, or Firm*—Felfe & Lynch

[57] ABSTRACT

A lid opener for accommodating wide and narrow rim lids, especially lids with an outwardly extending skirt portion which is crimped or curled over to form a reinforcing bead. The opener includes a strap loop attached to one or both ends to a handle. The strap is adapted to encircle the lid and be cinched thereagainst by the handle to apply a leveraged turning force to open the lid.

3 Claims, 1 Drawing Sheet

Reinforcing
42
18
41
41
40

16
10
16
30
18
14

Wide Rim Cap
41
40'
18
41
62
60
Narrow Rim Cap
51
50
41
18
40'
52

60°
16
12
60°
15
18
14
10

10
16
12
15

18
Force
10
30

41
41
40

LID REMOVER

This invention relates to a lid opener capable of accommodating wide and narrow rims.

Lid openers of the type having a handle and a loop which is cinched against the lid to apply leveraged turning forces are known from the following U.S. patents:

| | | |
|---|---|---|
| 178,655 | McLain | June 13, 1876 |
| 285,048 | Liljencrantz | Sept. 18, 1883 |
| 1,348,532 | Arndt | Aug. 3, 1920 |
| 2,458,393 | Loudfoot | Jan. 4, 1949 |
| 2,771,802 | Lewis | Nov. 27, 1956 |
| 3,678,788 | Matti | July 25, 1972 |
| DES. 268,164 | Sandberg | Mar. 8, 1983 |

The present invention provides an improvement in lid openers of this type for accommodating wide and narrow rim lids, especially lids with an outwardly extending skirt portion which is commonly crimped or curled over to form a reinforcing bead. The improvement includes a strap loop attached at one or both ends to a handle. The strap is adapted to encircle the lid and be cinched thereagainst by the handle to apply a leveraged turning force to open the lid.

The strap has a gripping surface, preferably of a non-sliding rubber or polymeric material, which has a recessed groove capable of engaging wide and narrow lid rims and of receiving the outwardly extending skirt portion of a narrow lid rim. This enables the gripping surface to securely engage both wide and narrow lid rims for applying a leveraged turning force.

The present invention will be more fully understood from the following description and the accompanying drawing wherein.

Figures 1, 2, 3, 4, 5, 6, 7:
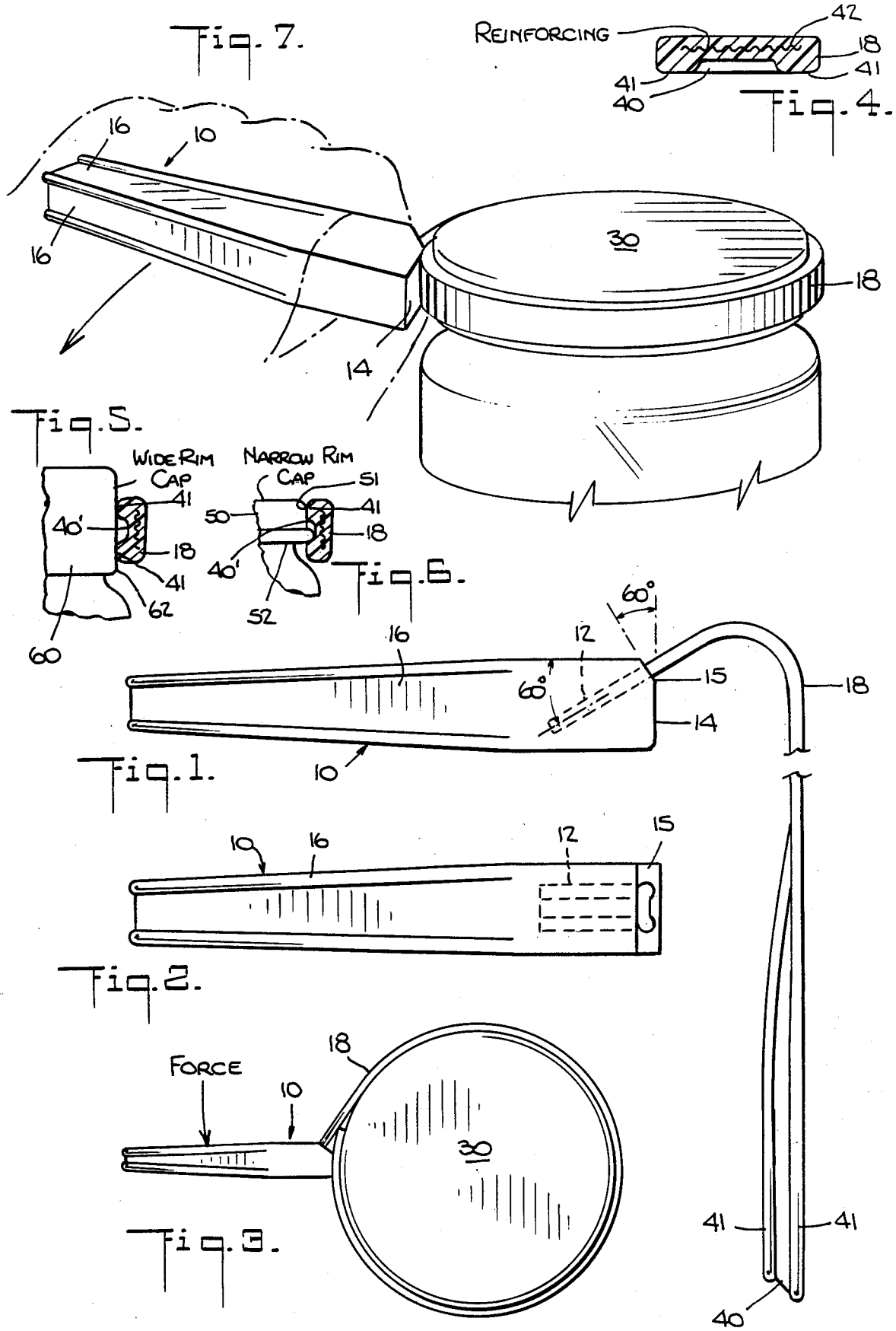
FIG. 1 is a side view of the lid opener of the invention with the strap shown partly in perspective.
FIG. 2 is a top view of the handle of the lid opener.
FIG. 3 is a top view showing the lid opener engaging a container lid for opening same.

FIGS. 4, 5 and 6 cross-sectional views of preferred strap configurations for use with wide and narrow lid rims; and FIG. 7 is a perspective view of FIG. 3.

Referring now to the drawing, the lid opener includes a handle 10 having a blunt front end 14 and side faces 16. A slot 12 is formed in a cut-off corner 15 where end 14 and face 16 meet. The slot 12 is preferably at 60 degrees from the horizontal so that the strap 18 is seated in slot 12 and exits therefrom at an angle of 60 degrees from the vertical. The corner 15 is also at an angle of 60 degrees from the horizontal. These angles enable the strap 18 to be positioned in a tangential attitude for encircling a lid. Slot 12 (FIG. 2) is configured to have a cross-sectional shape corresponding to the cross-sectional shape of strap 18.

The handle 10 can be square and tapered with edge beads as shown or can have other shapes such as round. The handle can be made of wood, plastic, metal or the like.

The strap 18 is attached at one end of the handle 10 via slot 12. Alternatively, both ends of strap 18 can be attached to the handle to provide a closed loop as shown in expired Matti patent No. 3,678,788.

The strap 18, preferably reinforced with Fiberglas or the like 42 (FIG. 4) is provided with gripping surfaces 41 for engaging a lid rim and a recessed groove 40 which can have a flat U-shape as shown in FIGS. 1 and 4 or a semi-circular shape 40' as shown in FIGS. 5 and 6.

In the case of a narrow rim lid 50 (FIG. 6), the gripping surfaces 42 engage the narrow rim 51 while groove 40' accommodates rim portion 52 which is an outwardly extending skirt portion. Such skirt portions cause other loop type openers to slip off and malfunction with lids with narrow rims. The groove 40 or 40' effectively bridges over the skirt portion 52 to securely engage the narrow rim 51.

The strap 18 works as well with lids 60 (FIG. 5) having wide rims 62 in which case the gripping surfaces 41 engage the rim 62.

In operation, the handle 10 is held in the right hand and the strap 18 with groove 40 toward the rim encircles lid 30 (FIG. 3 and 7) counter lclockwise with the free end under the front end 14 of the handle 10. The handle 10 is cinched at a right angle to the rim and leveraged turning force is applied as shown.

What is claimed is:

1. In a lid opener of the type having loop means attached at one or both ends to handle means, said loop means adapted to encircle and be cinched against the lid by the handle means and to be turned therewith to screw the lid loose from a container, the improvement for accommodating wide and narrow rim lids which comprises strap loop means having a gripping surface for engaging the rim of wide and narrow lids and a recessed groove which is capable of receiving the outwardly extending skirt portion of a narrow lid rim thereby allowing the gripping surface to securely engage wide and narrow lids.

2. Opener of claim 1 wherein the loop means is of a non-sliding flexible rubber or plastic material.

3. Opener of claim 2 wherein the rubber or plastic material is reinforced.

* * * * *